United States Patent [19]

Palau

[11] 4,182,380

[45] Jan. 8, 1980

[54] DOBBIES FOR WEAVING LOOMS

[75] Inventor: Joseph Palau, Duingt, France

[73] Assignee: Societe Anonyme des Etablissments Staubli, Faverges, France

[21] Appl. No.: 906,504

[22] Filed: May 16, 1978

[30] Foreign Application Priority Data

May 27, 1977 [FR] France ..... 77 17299

[51] Int. Cl.[2] ..... D03C 1/08

[52] U.S. Cl. ..... 139/68; 139/71

[58] Field of Search ..... 139/66 R, 67, 68, 71, 139/72, 74, 66, 1

[56] References Cited

U.S. PATENT DOCUMENTS

| | | | |
|---|---|---|---|
| 3,378,038 | 4/1968 | Hadinec | 139/68 |
| 3,381,719 | 5/1968 | Favre | 139/68 |
| 3,602,265 | 8/1971 | Palau | 139/71 |

*Primary Examiner*—Henry Jaudon
*Attorney, Agent, or Firm*—Dowell & Dowell

[57] ABSTRACT

A dobby for a weaving loom, of the type in which each dobby element associated with a heddle frame or group of heddle frames comprises an actuating lever actuated by a reciprocating movement, a double swinging lever pivoted thereon and of which the ends are provided with fastening hooks, this double swinging lever being actuated by two cross-pieces carried by oscillating supports and common to all the elements of the dobby, and two retaining hooks adapted to selectively cooperate with the fastening hooks, each of these retaining hooks comprising on the one hand a first or main portion pivoted on the frame and which bears the hooking nose, on the other hand, a second selection portion pivoted on the first, connected thereto by a spring and stop system, and receiving the action of the weave mechanism, the whole being such that this mechanism may achieve the selection of the double swinging lever in question by displacing the second portion of one of the retaining hooks before the corresponding fastening hook has arrived at the end of backward stroke, this retaining hook being latched in the manner of a pawl on passage of said fastening hook to hook therebehind, while with each of the two rows of retaining hooks of the dobby there is associated a locking bar actuated by a reciprocating movement and which cooperates with the first portion of each hook of the row in question to lock this portion either in a retracted position for which the retaining hook in question cannot retain the corresponding fastening hook, or on the contrary in the engaged position for which this first portion hooks to said fastening hook, which bars alternately release the first portions of the retaining hooks during the selection, one for even strokes, the other for odd strokes, wherein in each element the second or selection portions of the two retaining hooks are actuated during selection by a single member associated with the pattern mechanism.

9 Claims, 8 Drawing Figures

DOBBIES FOR WEAVING LOOMS

The present invention relates to double lift dobbies of the type in which each of the ends of the double swinging lever corresponding to a heddle frame or group of frames of the loom comprises a fastening hook adapted to cooperate with a retaining hook itself comprising on the one hand a first portion pivoted on the frame and which bears the hooking nose, on the other hand, a second portion pivoted on the preceding one, connected thereto by a spring and stop system, and receiving the action of the weave mechanism, this mechanism being such as to be able to prepare the selection of the double swinging lever in question by displacing the above-mentioned second portion of one of the retaining hooks before the corresponding fastening hook arrives at the end of backward stroke, this retaining hook being retracted in the manner of a pawl upon passage of said fastening hook, to be hooked behind it.

In heretofore known dobbies of the type in question, the weave mechanism acting on the second portions of the retaining hooks may be of any type. It is in particular possible to couple with these second portions needles working either in traction or in thrust and which may either feel the punched card directly, the second portions mentioned above being driven in reciprocal movement by a suitable device for example with eccentrics, or may receive the action of a set of bars with double reciprocating movement, the selection then being made by means of feeler needles which feel the paper in the well known Verdol jacquard manner. For each element of the dobby, i.e., for each of the double swinging levers thereof, two needles must be provided, corresponding respectively to one and the other of the retaining hooks associated with the element in question and the pattern strip must comprise two rows of perforations. If, as is well known in the art, and as is sometimes necessary to eliminate a broken filling thread or to correct a weaving defect, etc., the dobby must function in reverse, two needles are required for each hook, or a total of four per element, or auxiliary devices for displacing the needles with respect to the punched card must be provided. All this complicates the dobby. Moreover, the needles risk vibrating at high speeds, provoking errors in selection. Finally, for each retaining hook, a spring must be provided for returning the first portion of this hook to its reset position and a spring for returning the second portion to its stop position against the first portion, these springs having to be suitably calibrated with respect to each other, this multiplying the possible causes of defective functioning.

In these known dobbies, a more positive and more reliable functioning has been ensured by providing two reciprocating locking bars which lock the first portions of the retaining hooks of all the elements either in the engaged position or in the retracted position, thus avoiding untimely engagements or disengagements, but the reliability nevertheless remains bound to the correct calibration of the return springs and the presence of these bars does not simplify the weave mechanism.

It is an object of the present invention to remedy the drawbacks which have been set forth hereinabove.

In accordance with the invention, in each element of the dobby, the second portions of the two retaining hooks are actuated for each direction of motion by a single member associated with the weave mechanism.

Each of these control members is advantageously produced in the form of a push rod whose head is guided substantially in the plane of symmetry of the two hooks, whilst its shank is displaced transversely to this plane by the weave mechanism so as selectively to receive the action of at least one thrust member common to all the elements and animated by a reciprocating movement in synchronism with the functioning of the loom.

In the case of a dobby with reverse motion, two thrust members are provided, suitably shifted with respect to each other and these members are made in the form of two imbricated reeds, disposed laterally with respect to the row of push rods (therefore above or below this row), their teeth being oriented towards them so as to cooperate selectively with corresponding teeth provided on said push rods. As regards the weave mechanism ensuring the selection of the push rods, it may be established in known manner by means of feeler needles coupled to said push rods and cooperating with a strip of punched card.

The invention will be more readily understood on reading the following description with reference to the accompanying drawings, in which.

Figure 2:
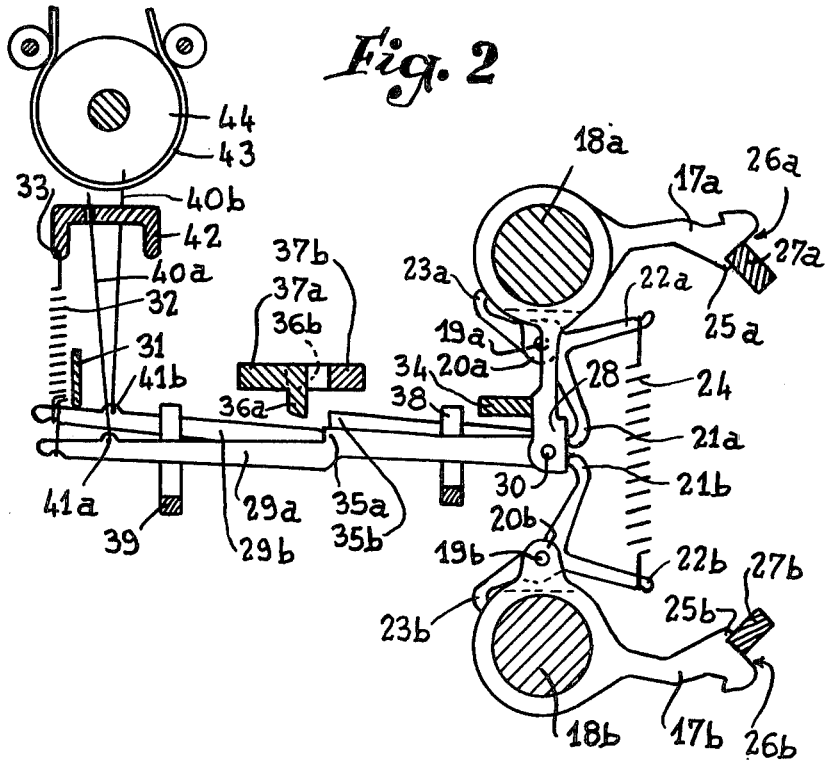
FIG. 2 is a partial transverse section on a larger scale showing a push rod and its control mechanism.
Figure 7:
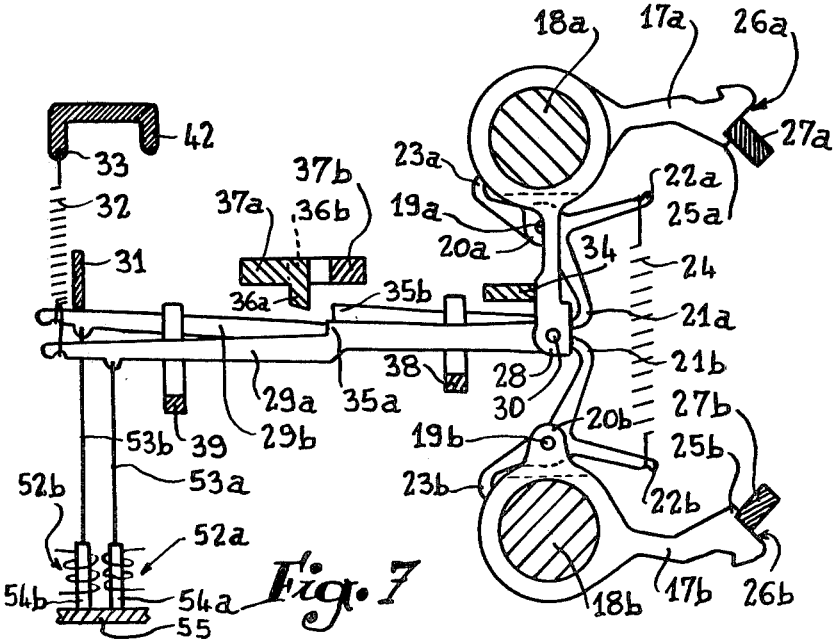

FIG. 7 reproduces FIG. 2, but indicating a mode of electromagnetic control of the selection of the push rods.

Figure 8:
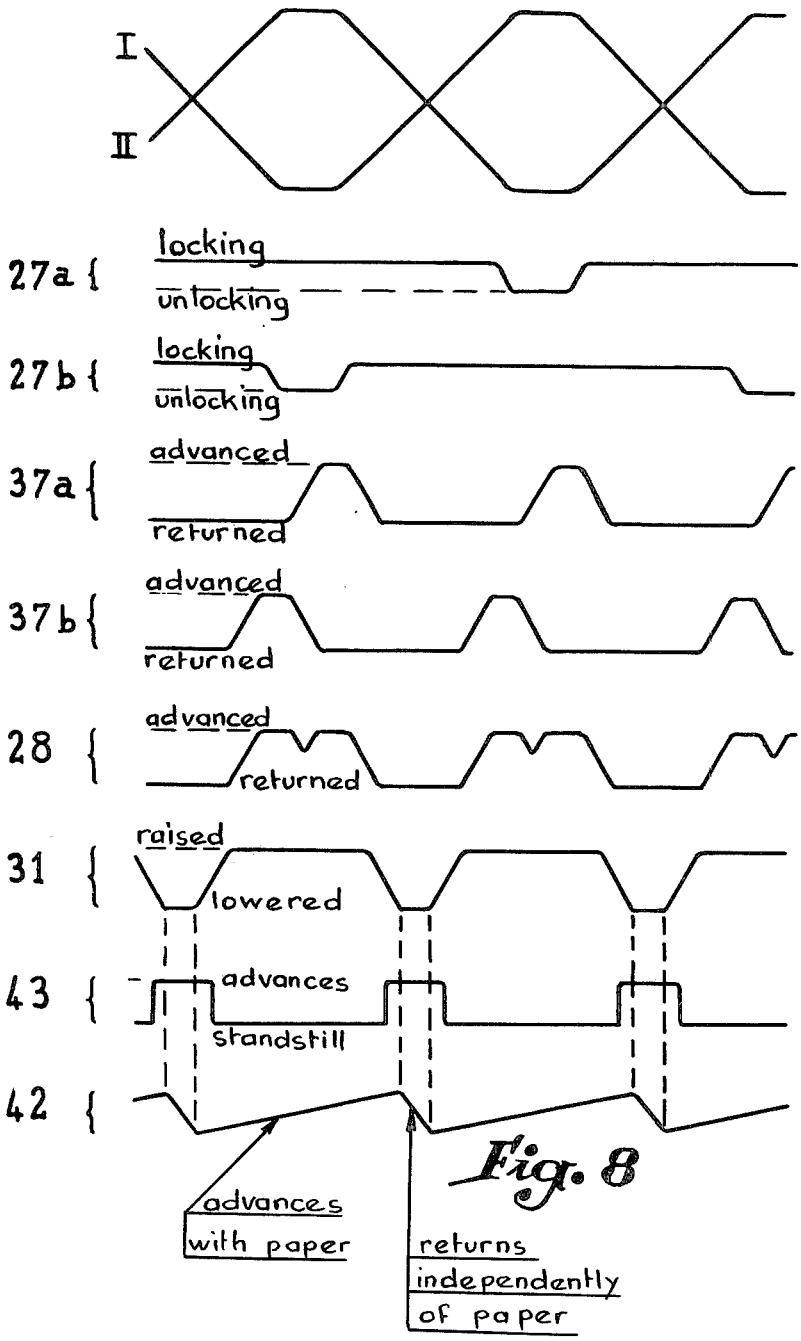

FIG. 8 is a graph showing the functioning of the dobby as a whole.

Figure 1:
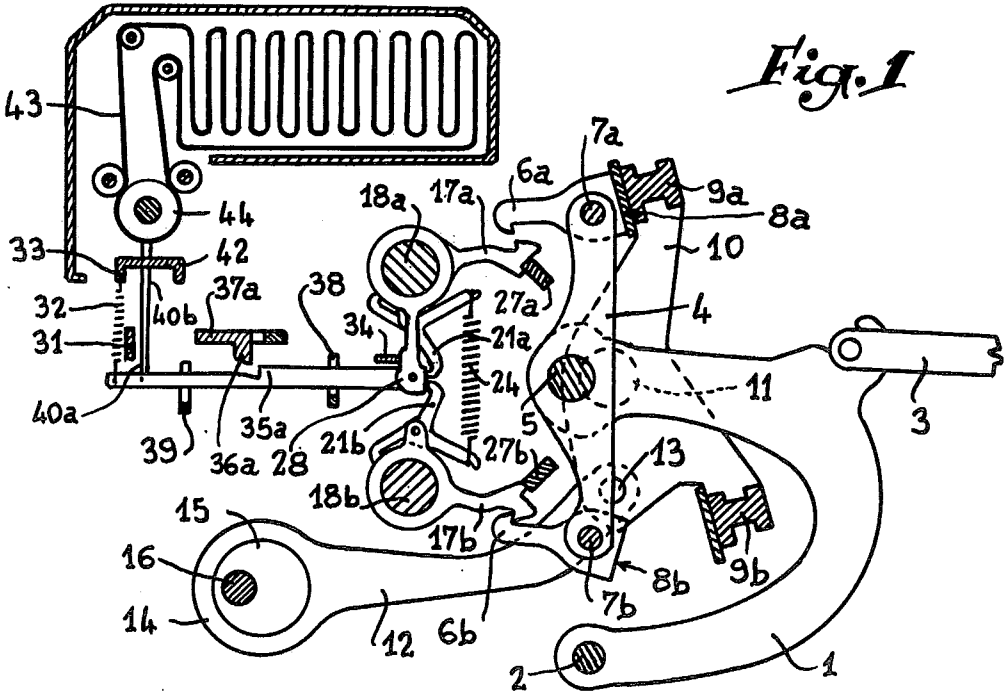
FIG. 1 is a transverse section through a dobby according to the invention. In order not to complicate the drawing, it has been assumed that the other elements of said dobby were located in front of the plane of the Figure.

Referring now to the drawings, the dobby according to the invention, of which the whole of an element has been shown in FIG. 1, conventionally comprises an actuating lever 1 mounted on a transverse fixed shaft 2 common to all the elements, this actuating lever actuating a connecting rod 3 suitably connected to a heddle frame of the loom or to a group of such frames having to function in identical manner. The connecting mechanism has not been given in detail, it conventionally comprising a lever for adjusting amplitude and a system of cables and guide pulleys. The actuating lever 1, provided to be approximately in the form of an arc of a circle, bears at its end a double swinging lever 4, i.e., a type of double lever with aligned arms of equal length, which is pivoted thereon by its centre at 5. Each of the ends of the double swinging lever 4 pivotally supports a fastening hook *6a* and *6b* respectively, pivoted at *7a, 7b* respectively and the heel of which comprises a flat bearing surface *8a, 8b* respectively. The dobby is further provided with two cross-pieces *9a, 9b* common to all the elements and the assembly of which is supported by two opposite end pieces 10 mounted to oscillate on the fixed frame (not shown) of this dobby by means of tail shafts such as 11. A suitable mechanism such as a connecting rod 12 coupled on the one hand at 13 to the end piece 10 in question and on the other hand at 14 to an eccentric 15 mounted on a shaft 16 driven at a rate of one revolution for two "strokes" of the loom, causes the crosspieces 9a 9b to reciprocate so that they are applied against the bearing surfaces 8a, 8b of the fastening hooks 6a, 6b by positively orienting these latter and normally making the double swinging lever 4 of the element in question oscillate when these hooks are free. Finally, opposite the fastening hooks 6a, 6b there are provided two retaining hooks 17a and 17b each comprising a first or main portion 17a, 17b respectively mounted idly on a common shaft 18a, 18b respectively, these retaining hooks being adapted to cooperate selectively with the fastening hooks mentioned above.

The construction described up to now is completely conventional. The functioning thereof will be recalled briefly: When the two retaining hooks (or more exactly their main portions) 17a, 17b are disengaged (position of FIG. 2), the double swinging lever 4 may oscillate freely about its axis 5 under the effect of the crosspieces 9a, 9b and the actuating lever 1 is not actuated. However, if, when a fastening hook, 6a for example, is in advanced position, the corresponding retaining hook 17a is engaged, during the advance of the opposite crosspiece 9b, the double swinging lever can no longer oscillate freely and consequently its axis 5 moves forward, causing the actuating lever 1 to advance.

Each retaining hook comprises, in addition to its main portion 17a, 17b which bears the tooth for hooking with the corresponding fastening hook 6a, 6b, a second or selection portion which is pivoted thereto about an axis 19a, 19b carried by a lateral lug 20a, 20b each comprising part of the retaining hook member 17a, 17b (FIG. 5), these two lugs being oriented towards each other, as shown. The second portion mentioned above itself comprises an actuating arm 21a, 21b, a return arm 22a, 22b and a stop heel 23a, 23b for abutting annular portion of each retaining hook 17a, 17b. The two actuating arms 21a, 21b are oriented towards each other, their free ends being at a short distance from each other between the two shafts 18a, 18b. The two return arms are roughly oriented towards the respective fastening hooks (cf. FIG. 1) and they are connected to each other by a return spring 24. Finally, two stop heels 23a, 23b oriented roughly in opposite direction from the return arms, are adapted to abut under the effect of the spring 24 against the corresponding main portion 17a, 17b, in the annular zone thereof which surrounds the shaft 18a, 18b. The function of the heels 23a, 23b is to form stops which limit the pivoting of each actuating arm 21a, 21b with respect to the retaining hook portions 17a, 17b.

It should be noted that in the absence of any outside action, the spring 24 maintains the heels 23a, 23b against the main portions 17a, 17b and therefore the spring 24 tends to cause said retaining hooks 17a, and 17b to rotate about shafts 18a, 18b in the direction tending to hook the auxiliary teeth 25a, 25b behind the transverse locking bar 27a, 27b, (or clockwise for 17a and anticlockwise for 17b).

The main portion 17a, 17b of each retaining hook comprises, opposite its hooking tooth, an auxiliary tooth 25a, 25b (FIG. 2) of rectangular section, which projects from the back 26a, 26b of said hooking tooth. In addition, there is associated with each retaining hook a transverse locking bar 27a, 27b common to all the elements of the dobby. When the hook in question is disengaged (upper retaining hook in FIG. 1), its locking bar 27a is applied against its back 26a and against the adjacent side face of its auxiliary tooth 25a, whilst, when the hook is engaged (lower hook in FIG. 1), its locking bar 27b abuts against the top of the auxiliary tooth 25b. In either case, the main portion of the hook in question is prevented from rotating under the action of the spring 24 and therefore remains held in position. However, as will be described in detail hereinafter, during the cycle of functioning of the loom, the bars 27a, 27b momentarily move away from the retaining hooks in the oblique direction indicated by the arrow in FIG. 4 (i.e., virtually parallel to the straight side faces of the auxiliary tooth 25a, 25b) so as to release the upper and lower retaining hooks alternately, with a view to their selection.

In other words, in the dobby assembly, each locking bar 27a, 27b is retracted during the selection of the retaining hooks with which it is associated, then it returns to lock them in the position which has been given to them (retracted position or engaged position).

The locking bars 27a, 27b are preferably controlled by cams, as will be described hereinafter with reference to FIG. 8.

With each element of the dobby there is associated a double push rod comprising a selection head 28 suspended from an annular upper portion which freely surrounds the shaft 18a independent of the retaining hook 17a so that the pivot 30 will move in an arc of a circle approximately along a horizontal path to the limit of its movements, and further comprising two flat rods 29a, 29b (one for forward motion, one for reverse motion) of which the righthand ends in FIG. 2 terminate inside the head 28, formed in the form of a stirrup, and are pivoted thereto about an axis 30 parallel to the shafts 18a, 18b. These rods extend virtually horizontally towards the left, their free ends being returned upwardly against a stop levelling bar 31 by individual springs 32 attached to the frame of the dobby at 33. On the other hand, there is provided another stop crosspiece 34 which limits the displacement of the heads 28 towards the left under the effect of the actuating arms 21a, 21b when said latter are free to obey the springs 24.

Figure 3:
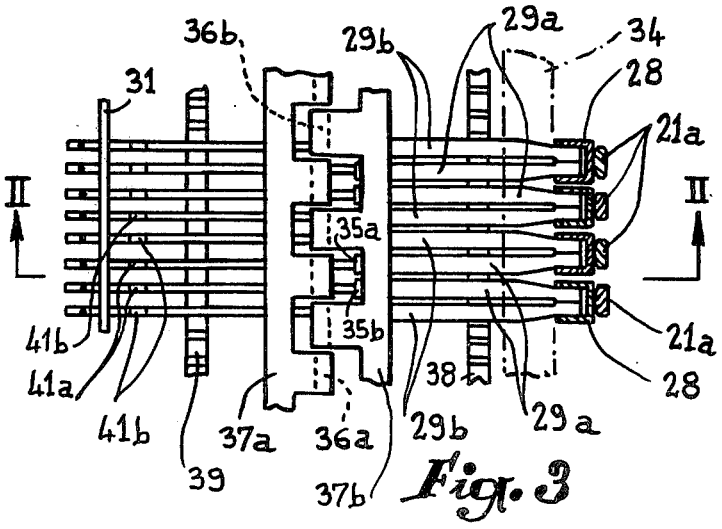
FIG. 3 is a partial plan view illustrating the arrangement of the push rods and their actuating reeds.

The upper edge of the flat rods 29a, 29b of each push rod is of stepped section so as to determine a vertical tooth 35a, 35b oriented towards the left (therefore opposite the head 28) and which, when the rod has been selected by lifting of its left-hand end and rotation about the axis 30, in the manner which will be seen hereinafter, is actuated by a corresponding tooth 36a, 36b of a reed 37a, 37b respectively, these two reeds being adapted to reciprocate horizontally as will be set forth hereinbelow. FIG. 3 shows that in the successive elements of the dobby, the rods 29a, 29b are disposed in inversed manner in order that the same tooth, such as for example 36a, may correspond to two adjacent rods such as 29a, obviously simplifying the production of the reeds 37a, 37b. When a rod 29a, or 29b is thus displaced towards the right by the reed which corresponds thereto, the head 28 tends to push the actuating arms 21a, 21b of the second portions of the two retaining hooks of the element of the dobby in question.

The pairs of rods 29a, 29b are guided transversely by the teeth of two fixed reeds 38 and 39 (FIGS. 2 and 3). As to their selection, this is ensured by needles 40a, 40b (FIG. 2), each of which is fastened by the bottom to a lug 41a, 41b to the rod in question and which rise to pass through a crosspiece 42 acting as perforated guide plate and from there, to feel a pattern strip or punched card 43 wound on a perforated drum 44. On the other hand, the levelling bar 31 mentioned above is provided to be vertically mobile to lower the left-hand ends of the rods 29a, 29b with the needles 40a, 40b during each cycle against the springs 32. Depending on the case, the pattern strip or card may advance in jerked movements in conventional manner, or continuously, the crosspiece or plate 42 then having to reciprocate to advance with it and return rearwards during the period of disengagement of the needles, in known manner.

Figure 4:
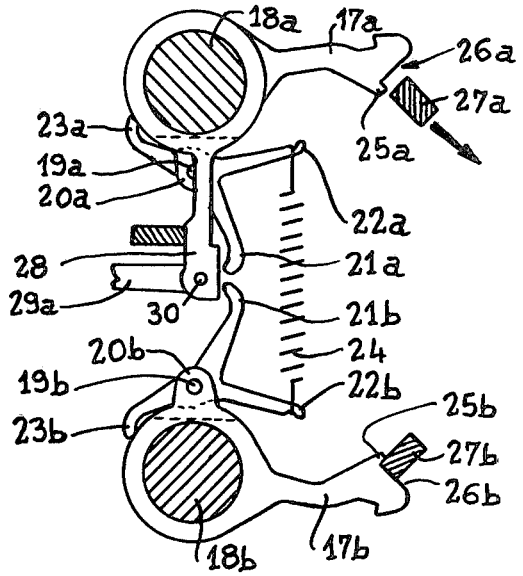
FIGS. 4 and 5 show two positions of the essential pieces of an element of the dobby during operation.
Figure 5:
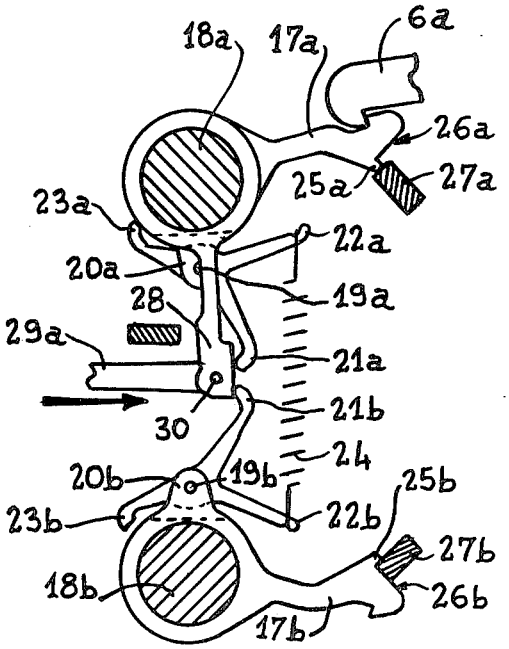

To simplify the explanations concerning the action of rods 29a, 29b, it will firstly be assumed that, during a cycle, the forward motion rod 29a is the only one displaced towards the right by the reed 37a which corresponds thereto (what happens if the reverse motion rod 29b is also displaced during the cycle and why its displacement remains without effect, will be seen hereinafter). The movement of the locking bars 27a, 27b is regulated so that at this instant one of them has been momentarily brought to the disengaged position for which it releases the main portion 17a, 17b of one of the two retaining hooks of the element in question, the other bar being in its locked position. Three hypotheses are then to be envisaged:

(1) The main portions 17a, 17b of the two retaining hooks are in the retracted position of FIG. 2. In this case, and as shown in FIG. 4, the one which is no longer locked by its bar (upper hook) rotates under the effect of its actuating arm 21a; in fact, the heel 23a being held against the periphery of the annular zone of the main portion 17a by the effect of the spring 24, the assembly 17a, 21a behaves like a single rigid piece rotated by the head 28 against the return action of the spring 24. The main portion 17a thus arrives in the engaged position in which it is then locked by the bar 27a which returns to its rest position (FIG. 5). The dobby is regulated so that this occurs at the instant when the corresponding fastening hook 6a terminates its backward stroke so that the two hooks hook on each other and are locked in hooked position. As to the main portion 17b of the other retaining hook, as it is locked by its bar 27b, it cannot follow its actuating arm and remains in retracted position (FIG. 5), its second portion 21b, 22b, 23b rotating simply about the axis 19b against the spring 24. Due to the engagement of one of the retaining hooks, the double swinging lever 4 can no longer oscillate freely and consequently the heddle frame or group of frames controlled by the connecting rod 3 of FIG. 1 will be raised.

(2) The main portion 17a of the retaining hook whose locking bar has been brought into retracted position is itself also in retracted position, but the main portion 17b of the other hook is locked in the engaged position. In this case, the first hook is brought to the engaged position as explained hereinabove. The double swinging lever 4 is then retained in the advanced position without being able to oscillate, with the result that the heddle frame or group of frames controlled by the dobby element in question remains in raised position.

(3) The main portion 17a of the retaining hook whose locking bar 27a is retracted is in engaged position. In this case, this main portion 17a is maintained in engaged position by the effect of the head 28 on the actuating arm 21a and of the stop of the heel 23a against the periphery of the annular zone of said portion 17a as explained hereinabove. As to the main portion 17b of the other retaining hook, due to the locking action of the bar 27b, it remains in the position in which it is found.

Of course, if the push rod is not actuated, the retaining hook such as 17a released by its bar 27a remains in disengaged position, if it were already there, or passes to this disengaged position if, on the contrary, it was engaged.

In this way, the single spring 24 ensures:

the return of the heels 23a, 23b against the annular zones of the main portions 17a, 17b of the retaining hooks;

the bringing of one of the main portions 17a, 17b to the engaged position after backward movement of a bar 27a 27b when the actuating arms are pushed by the head 28, as the heel 23a 23b remains applied against the annular zone mentioned above;

the return of the main portion 17a, 17b to the retracted position when it is released by its locking bar and when the head of the push rod is not advanced by the reeds;

the return towards the left of the head 28 against the crosspiece 34.

In addition, it allows the displacement of the second portion of each hook with respect to the first when this is necessary.

Figure 6:
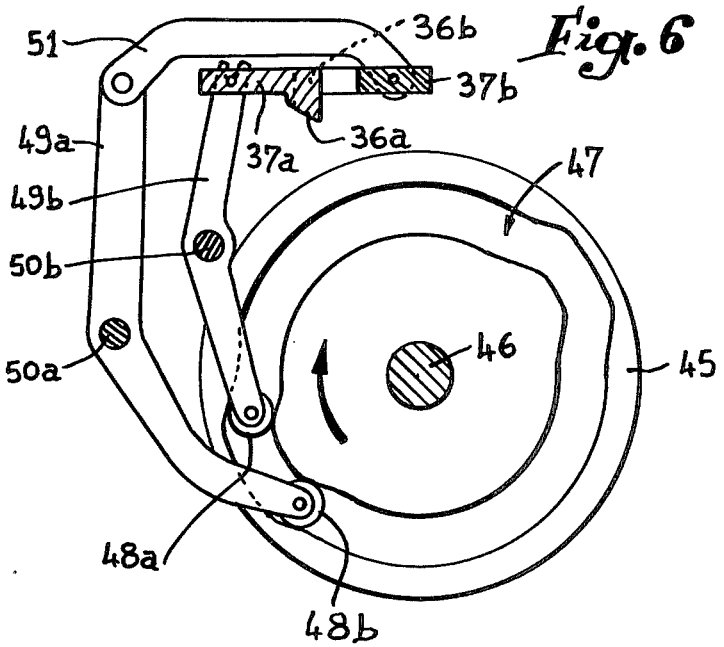
FIG. 6 illustrates the control of the reeds by means of a positive cam.

The movements of the locking bars 27a, 27b of the levelling bar 31 and the reeds 37a, 37b are preferably controlled by positive cams. FIG. 6 shows by way of example the mechanism which corresponds to the above-mentioned reeds, it being understood that similar mechanisms may be used for the various bars. This Figure shows at 45 a disc fixed to the shaft 46 of the dobby or on a shaft connected thereto. In one of the faces of this disc, a groove 47 has been made which positively actuates two rollers 48a, 48b respectively borne by double levers 49a, 49b mounted on fixed pivots 50a, 50b and the opposite end of which are suitably coupled to the two reeds. Concerning the reed 37a for forward motion, this fastening is effected by means of a groove and pin system, whilst, for the reed 37b for reverse motion, a connecting rod 51 is provided. As shown, the section of the groove 47 is symmetrical, but the rollers 48a, 48b are offset with respect to each other, so that their cycles of movement are shifted and the same applies for the reeds (cf. lines 37a and 37b in FIG. 8). Of course, these reeds, as well as the locking bars 27a, 27b and the levelling crosspiece or bar 31 are suitably guided in the frame of the dobby.

FIG. 7 indicates a variant of the selection control of the rods 29a, 29b of the push rods. The return springs 32 attached to the crosspiece 42 are found again, as well as the levelling crosspiece or bar 31. However, the selective vertical displacement of the left end of said rods is obtained by means of electromagnets 52a, 52b of which the mobile cores are fastened thereto by wires 53a, 53b. 54a, 54b are corresponding fixed counter-cores borne by a crosspiece 55. A suitable system selectively sends the current to the electromagnets during the lowering of the levelling bar, so that, when this latter rises, the rods corresponding to the energized electromagnets remain in lowered position. It will be noted that said latter are disposed in quincunx on the crosspiece 55 to reduce the width of the whole.

The selective sending of the current to the electromagnets may be effected by any known means in the art of electrically controlled weave mechanisms.

Of course, if the electromagnets are powerful enough, the levelling bar may be eliminated, the magnetic attraction being sufficient to lower the rods selectively.

FIG. 8 shows the movements of the various essential members of the dobby and makes it possible to understand how, although the reverse motion rods 29*b* are never placed out of action, they do not intervene during forward motion, whilst, similarly, the forward motion rods 29*a* do not intervene either when the dobby is rotated in reverse. In this figure, for forward motion, the lines should be read from left to right and vice versa for reverse motion. The locking bars 27*a*, 27*b* move between the locked position and unlocked position. When a reed 37*a*, 37*b* advances, it actuates the selected rods and when it moves backwards, it releases them for the following selection. The second to last line corresponds to the advance of the pattern 43 when the cylinder 44 rotates in successive jerks, the crosspiece or plate 42 remaining fixed, whilst the last line envisages the case of a continuous rotation of the cylinder, the plate firstly following the card, then moving backwards during the lowering of the needles to be shifted by one step or feeling zone with respect to said card.

To simplify explanations, it has been assumed that only two frames I and II were provided, making a simple taffeta weave. As shown by the first line, these two frames oscillate then with a shift of 180°. The locking bar 27*a* moves back each time that frame I arrives in low position and advances as soon as it rises. Its movement is centered with respect to that of the frames. The bar 27*b* effects an identical movement, but with a shift of 180° so as to correspond to the low positions of the frame II or high positions of frame I. The forward motion reed 37*a* advances as soon as one or the other of the bars 27*a*, 27*b* has moved backwards completely, then it moves backwards immediately it has completely returned to the advanced (locked) position. Consequently, its movement is slightly shifted (delayed—therefore towards the right) with respect to that of the above-mentioned bars. The reverse motion reed 37*b* makes exactly the same movement, but following the graph from right to left and no longer from left to right, so that its movement is shifted in advance (towards the left). Moreover, it is clearly seen that the movements of the two reeds are symmetrical with respect to the mediatrix of the horizontal segment which corresponds to the backward or unlocked position of said bars. The displacements of the reeds add up to some extent to actuate the head 28 which, if the graph is read from left to right (forward motion) is firstly advanced by the reed 37*b* (and of course the rod 29*a*), then begins to move backwards with this reed, but is advanced again by the reed 37*a*. As regards the levelling bar 31, its lowering times are centered with respect to the points of intersection of the frames (or more exactly the lines which represent their movements). It is easily noted that these times appear when the locking bars are in advanced (locked) position and the reeds are on the contrary in backward position.

This being so, it should be noted that, if forward motion is effected (reading of the graph from left to right), the reverse motion reed 37*b* returns to its backward position (without action on the rods 29*b*) whilst one or the other of the locking bars 27*a*, 27*b* is still in backward position. The result of this is that, if this reed has caused the rod 29*b* to advance, which has perhaps acted on an actuating arm 21*a*, 21*b* by means of the head 28, this arm has already returned to its earlier position when the corresponding locking bar advances. Therefore the selection that this rod 29*b* has been able to make is only transistory and does not remain. Hence it is concluded that during forward motion the reed 37*b* and the rods 29*b* are without action on the dobby, or in other words, they function idly.

Of course, if the case of reverse motion is considered, i.e., if the graph of FIG. 8 is followed from right to left, an exactly reverse conclusion from the preceding one will be reached, namely that during this reverse motion the forward motion rods 29*a* have moved backwards completely before the locking bars advance, so that these rods and the corresponding reed 37*a* function idly.

Under these conditions, it suffices that the two groups of needles 40*a* and 40*b* be guided in the crosspiece or plate 42 so that their feeling zones on the pattern 43 are offset by two wefts (a lowering and a lifting of a frame) in order that, from the beginning of the reverse motion, the corresponding ones 40*a* feel the perforations representing the stroke already made in forward motion.

Of course, nothing prevents the pattern from comprising two series of perforations, one for forward motion, one for reverse motion, in which case all the needles may be located on the same line.

In any case, the invention makes it possible to provide for each element and for each direction of motion only one actuating member (head 28) for the arms 21*a*, 21*b* actuating the retaining hooks, this considerably simplifying the dobby. In addition, the rods 29*a*, 29*b* cannot bend substantially in the vertical direction, whilst they are retained in the transverse direction, this excluding any vibration capable of bringing about an error in selection. Finally, each element comprises only one spring exerting a considerable error, namely spring 24 (the springs 32 being very light), this considerably reducing the risks of defective functioning provoked by the weakening or break of a return member.

What I claim is:

1. In a loom dobby having a frame supporting multiple elements which are each coupled to a heddle-driving connecting rod through a reciprocating actuating lever having a forward and a rearward stroke and which supports a double swinging lever at a central pivot located between oppositely extending arms of the swinging lever, the arms having fastening hooks at their outer ends spaced from said pivot, and the outer ends of the arms being located to abut crosspieces common to all of said multiple elements, the crosspieces oscillating toward and away from the outer ends of the arms in timed relationship with the reciprocation of the actuating lever, and the dobby further having for each element a pair of retaining hooks located adjacent to the fastening hooks when the actuating lever is at the end of its rearward stroke, each of the retaining hooks being pivotally supported on the frame and each having a first portion comprising a hook moveable between a retracted inoperative position and a fastening-hook engaging position and each retaining hook having a second selection portion pivotally connected to the first portion and coupled to spring means yieldably urging the first hook portion to said retracted position, and the dobby having locking bar means located adjacent to said first portions of the retaining hooks and reciprocated into and out of engagement therewith in timed relationship with the reciprocation of the actuating lever to lock the retaining hooks into their selected positions and to unlock the retaining hooks for selection on alternate reciprocations of the actuating lever, and the dobby having a pattern mechanism, and having means selected by the pattern mechanism and operative for actuating said second selecting portions of the retaining hooks, said means comprising:

a single pusher member contacting both second selecting portions in each pair of retaining hooks and operative to actuate said second portions;

at least one driving member corresponding with each pusher member and selectable by said pattern mechanism;

and actuating means driven in timed relationship with said stroke and operative to displace each driving member when selected to thereby actuate the corresponding pusher member.

2. A loom dobby as claimed in claim 1, wherein each driving member comprises a push rod coupled to a corresponding pusher member to actuate the latter.

3. A loom dobby as claimed in claim 1, wherein there are two driving members operatively associated with each single pusher member, the driving members being selectable by said pattern mechanism and respectively being operative for forward and reverse loom motions, and said actuating means engaging said two driving members in offset relationship for said forward and said reverse loom motions so that during each motion of the loom the displacement of the driving member associated with the other motion of the loom ceases while the first portions of the retaining hooks are still unlocked by the locking bars.

4. In a loom dobby having a frame supporting multiple elements which are each coupled to a heddle-driving connecting rod through a reciprocating actuating lever having a forward and a rearward stroke and which supports a double swinging lever at a central pivot located between oppositely extending arms of the swinging lever, the arms having fastening hooks at their outer ends spaced from said pivot, and the outer ends of the arms being located to abut crosspieces common to all of said multiple elements, the crosspieces oscillating toward and away from the outer ends of the arms in timed relationship with the reciprocation of the actuating lever, and the dobby further having for each element a pair of retaining hooks located adjacent to the fastening hooks when the actuating lever is at the end of its rearward stroke, each of the retaining hooks being pivotally supported on the frame and each having a first portion comprising a hook moveable between a retracted inoperative position and a fastening-hook engaging position and each retaining hook having a second selection portion pivotally connected to the first portion and coupled to spring means yieldably urging the first hook portion to said retracted position, and the dobby having locking bar means located adjacent to said first portions of the retaining hooks and reciprocated into and out of engagement therewith in timed relationship with the reciprocation of the actuating lever to lock the retaining hooks into their selected positions and to unlock the retaining hooks for selection on alternate reciprocations of the actuating lever, and the dobby having a pattern mechanism, and having means selected by the pattern mechanism for selecting said retaining hooks, said means comprising:

push rod means lying in a plane of symmetry between the paired retaining hooks and having at one end head means contacting both second selection portions of each pair of retaining hooks, the push rod means being coupled to the pattern mechanism and selectively displaceable thereby from said plane of symmetry;

and actuating reed member means reciprocating parallel to said plane of symmetry and in timed relationship with said stroke and located to engage those push rod means which are displaced from said plane, and operative to drive the heads of the engaged push rod means substantially along the plane to contact and actuate said second selection portions of corresponding retaining hooks to move the latter toward engaged positions.

5. The loom dobby as claimed in claim 4, wherein the push rod means and said actuating reed member means have opposing tooth members which mutually interengage when push rod means are displaced from said plane of symmetry.

6. The loom dobby as claimed in claim 5, wherein the push rod means for each dobby element comprises two flat adjacent rods lying in said plane, and a head pivotally interconnecting the ends of the rods located adjacent to said second selecting portions of paired retaining hooks, one rod being operative for forward loom motion and the other rod for reverse loom motion, and said actuating reed member means comprising two reed members engageable with different rods and differently timed for forward and reverse loom motions, and means for supporting and guiding the heads and the ends of the rods pivoted thereto for movement thereof substantially along said plane of symmetry.

7. The loom dobby as claimed in claim 6, wherein said two reed members are mutually located in imbricated relationship, and wherein the paired rods of adjacent dobby elements are inversely paired in said plane of symmetry so that the tooth members of each reed member lies in operative relationship opposite the tooth members of two push rods of different dobby elements but corresponding with the same direction of loom motion.

8. The loom dobby as claimed in claim 4, wherein the dobby includes a perforated pattern; feeler needles operatively associated with the pattern to feel the perforations therein; means operative in timed relationship with said stroke for alternately bringing the needles and the pattern together and then separating them; and said needles being connected directly to said push rod means to displace selected ones thereof from said plane of symmetry.

9. In a loom dobby having a frame supporting multiple elements which are each coupled to a heddle-driving connecting rod through a reciprocating actuating lever having a forward and a rearward stroke and which supports a double swinging lever at a central pivot located between oppositely extending arms of the swinging lever, the arms having fastening hooks at their outer ends spaced from said pivot, and the outer ends of the arms being located to abut crosspieces common to all of said multiple elements, the crosspieces oscillating toward and away from the outer ends of the arms in time relationship with the reciprocation of the actuating lever, and the dobby further having for each element a pair of retaining hooks located adjacent to the fastening hooks when the actuating lever is at the end of its rearward stroke, each of the retaining hooks being pivotally supported on the frame and each having a first portion comprising a hook moveable between a retracted inoperative position and a fastening-hook engaging position and each retaining hook having a second selection portion pivotally connected to the first portion and coupled to spring means yieldably urging the first hook portion to said retracted position, and the dobby having locking bar means located adjacent to said first portions of the retaining hooks and reciprocated into and out of engagement therewith in timed relationship with the reciprocation of the actuating lever to lock the retaining hooks into their selected positions and to unlock the retaining hooks for selection on alternate reciprocations of the actuating lever, and the dobby having a pattern mechanism, and having means selected by the pattern mechanism for selecting the retaining hooks, comprising:

a pusher head member lying in a plane of symmetry between the paired retaining hooks and contacting both second selection portions of each pair of retaining hooks, the pusher head members being selected by the pattern mechanism to contact and actuate associated second selection portions of corresponding retaining hooks in timed relationship with said stroke; and each second selection portion of each retaining hook comprising an actuating arm extending from one side of the pivotal connection of the second portion to the first portion and contacting a pusher head, and comprising a stop arm extending from the other side of said pivotal connection and abutting said first hook portion of the retaining hook, the axis of each pivotal connection being offset in the direction of said plane of symmetry from the pivotal support of the first hook portion on the frame, each spring means being stretched between two second selection portions of the same dobby elements so as to urge both stop arms into contact with said first hook portions, thereby yieldably urging said first hook portions to rotate about their supports to the frame toward said retracted positions, said actuating arms of the second selection portions urging unlocked first hook portions into engaging positions against the yielding tension of said spring means when the associated pusher head members are selected and actuated.

* * * * *